United States Patent [19]

Nagata

[11] Patent Number: 4,847,451

[45] Date of Patent: Jul. 11, 1989

[54] ELECTRIC TOOL POWER SWITCH ASSEMBLY PROVIDING CONVENIENT REVERSING OPERATION AND PROVIDED WITH SEALED SWITCH LEVER STRUCTURE

[75] Inventor: Kunio Nagata, Kyoto, Japan

[73] Assignee: Omron Tateisi Electronics Co., Kyoto, Japan

[21] Appl. No.: 98,067

[22] Filed: Sep. 17, 1987

[30] Foreign Application Priority Data

| | | | |
|---|---|---|---|
| Sep. 17, 1986 | [JP] | Japan | 61-143290[U] |
| Sep. 18, 1986 | [JP] | Japan | 61-143962[U] |
| Sep. 20, 1986 | [JP] | Japan | 61-144735[U] |
| Sep. 22, 1986 | [JP] | Japan | 61-145586[U] |

[51] Int. Cl.[4] ..... H01H 9/06

[52] U.S. Cl. ..... 200/1 V; 200/61.85; 200/522

[58] Field of Search ..... 200/1 V, 61.85, 157

[56] References Cited

U.S. PATENT DOCUMENTS

| | | | |
|---|---|---|---|
| 3,376,402 | 4/1968 | Bednarski | 200/157 |
| 4,581,499 | 4/1986 | Cousins | 200/1 V |

FOREIGN PATENT DOCUMENTS

| | | | |
|---|---|---|---|
| 110142 | 3/1940 | Australia | 200/157 |

*Primary Examiner*—A. D. Pellinen

*Assistant Examiner*—Morris Ginsburg

*Attorney, Agent, or Firm*—Wegner & Bretschneider

[57] ABSTRACT

An electric power tool includes an electric motor. A switch assembly for this power tool includes a device for controlling the on/off operation of the motor, actuated to and fro along a first actuation line, and a device for controlling the forward/reverse operation of the motor, actuated to and fro along a second actuation line. The first and the second actuation line do not intersect one another. This confers good operability upon the switch and upon the power tool as a whole. More particularly, the first actuation line should be skew to the second actuation line, even more particularly substantially skew perpendicular to it; or, alternatively, the first actuation line may be substantially parallel to the second actuation line and somewhat displaced therefrom. The device for controlling the on/off operation of the motor may include a lever extending from the outside of the power switch assembly to the inside thereof, the lever being pivoted about a pivot line so as to actuate the on/off operation of the motor and the lever being formed with an arcuate part cylindrical surface on its outside portion with respect to the pivot line, and the arcuate part cylindrical surface having substantially the same rotational center line as the pivot line; and, more particularly, it may further include a sealing elastic member provided as sealingly cooperating with the arcuate part cylindrical surface of the lever.

2 Claims, 9 Drawing Sheets

ELECTRIC TOOL POWER SWITCH ASSEMBLY PROVIDING CONVENIENT REVERSING OPERATION AND PROVIDED WITH SEALED SWITCH LEVER STRUCTURE

BACKGROUND OF THE INVENTION

The present invention relates to a power switch assembly for an electric tool such as a hand electric tool which is driven by a DC motor, and particularly relates to such a power switch assembly which is provided with a convenient means of reversing operation. Even more particularly, the present invention relates to such a power switch assembly, which particularly is provided with a means for properly sealing a switch lever structure which extends from its inside to its outside.

In the prior art, there have been proposed various types of electrically driven power tools such as electric screw drivers, electric power drills, electric saws, and the like. Such electric power tools have typically been powered by DC motors, and very often have been endowed with the function of selective reversibility, i.e. with the function that the rotational direction of an electric motor incorporated in the tool can be selectively reversed, at the discretion and at the behest of the user of the power tool. And various power switch assemblies have been proposed for such electric power tools, incorporating such a function of selective reversability. Also, the function of selectively variable controllability with regard to speed has been proposed; for example in Japanese Patent Laying Open Publication Serial No. 60-160918 (1985) which it is not hereby intended to admit as prior art to the present patent application except to the extent in any case mandated by applicable law, there is disclosed a type of switch for an electric power tool, in which the rotational speed of such an electric motor incorporated in the tool can be altered, i.e. which is endowed with a speed control unit which provides the function that the rotational speed of said electric motor can be selectably varied from slow through medium to fast, again at the discretion and at the behest of the user of the power tool.

However, this type of power switch assembly is subject to a number of problems.

First, since typically space is at a premium in such a construction, it is difficult to incorporate a reversing mechanism for such a power switch assembly in the same restricted compass as a speed control mechanism thereof. Accordingly, conventionally, the reversing mechanism has been typically incorporated in the grip of such an electric power tool, i.e. in a position remote from the speed control mechanism. Such a place, although necessitated for reasons of limited space availability, has been very inconvenient for operation of the power tool, and has often necessitated that the user of the power tool is required to use both hands, for performing certain control actions with respect to the power tool. This is most inconvenient and makes handling of the power tool more difficult.

Further, as such a speed control mechanism for such a power switch assembly for a power tool, it has been typical to utilize a slide type switch, which controls both the ON/OFF action for the motor of the power tool and the torque supplied by said motor, by being slid by the motion of a rocking lever or the like which extends from the interior of the power switch assembly to the outside thereof. However, since this construction requires an opening to be provided in the casing of the power switch assembly for accommodating the stroke of the rocking lever or the like, and since such an opening presents an opportunity for dust or dirt or the like to enter from the outside into the interior of the power switch assembly, which might inevitably engender poor functioning such as poor contact performance of the power switch assembly, therefore a special type of sealing arrangement for such an opening, such as a rubber bellows or the like, is inevitably required for accommodating the inevitably relatively large stroke of motion of such a lever. The relatively high cost of such a special type of sealing arrangement has been a major obstacle in the reduction of the overall cost of such a power switch assembly for such a power tool.

SUMMARY OF THE INVENTION

Accordingly, there has become evident a requirement for an improved electric tool power switch assembly. This problem has exercised the ingenuity of the inventors of the present invention.

Thus, it is the primary object of the present invention to provide an electric tool power switch assembly, which avoids the various problems detailed above.

It is a further object of the present invention to provide such an electric tool power switch assembly, which allows both the reversing mechanism and also the speed control mechanism to be incorporated together, so as to be fitted into the grip of the power tool.

It is a further object of the present invention to provide such an electric tool power switch assembly, which is efficient in its use of space.

It is a further object of the present invention to provide such an electric tool power switch assembly, which is convenient to use.

It is a further object of the present invention to provide such an electric tool power switch assembly, which allows both the reversing mechanism and also the speed control mechanism to be operated with one and the same hand.

It is a further object of the present invention to provide such an electric tool power switch assembly, which has good handleability and good usability.

It is a further object of the present invention to provide such an electric tool power switch assembly, which has a high quality with regard to ergonomics.

It is a yet further object of the present invention to provide such an electric tool power switch assembly, the interior of which is well sealed from the outside thereof.

It is a yet further object of the present invention to provide such an electric tool power switch assembly, which is not prone to the entry of dust or dirt or the like from the outside into its interior.

It is a yet further object of the present invention to provide such an electric tool power switch assembly, which is not subject to undue deterioration of its contact performance due to contamination.

It is a yet further object of the present invention to provide such an electric tool power switch assembly, the gap in the casing of which, which is necessarily required for passage of the actuating lever for the speed control mechanism of which, is as restricted as is practicable.

It is a yet further object of the present invention to provide such an electric tool power switch assembly, which does not incorporate any very expensive form of sealing structure for isolating its inside from the outside.

It is a yet further object of the present invention to provide such an electric tool power switch assembly, which is inexpensive.

According to the most general aspect of the present invention, these and other objects are attained by, for an electric power tool comprising an electric motor: a switch assembly, comprising: (a) a means for controlling the on/off operation of said motor, actuated to and fro along a first actuation line; and: (b) a means for controlling the forward/reverse operation of said motor, actuated to and fro along a second actuation line; wherein said first and said second actuation line do not intersect one another. Optionally, said first actuation line may be skew to said second actuation line, and more particularly may be substantially skew perpendicular to said second actuation line; or, alternatively, said first actuation line may be substantially parallel to said second actuation line and somewhat displaced therefrom.

According to such an electric tool power switch assembly as specified above, as will be explained in more detail later, the operation of the power tool can be very convenient, and, specifically, the rotational direction of the motor of the power tool can be reversed simply by transversely pushing the reverse means in and out relative to the casing of the power tool, and this can be conveniently done by the operator by using the same hand as that which is holding the grip portion of the power tool. Further, since this reversing action may be in the same direction as the action of gripping the power tool, and may be set at an angle (specifically, may be set at a right angle, i.e. skew perpendicular) to the action of controlling the switching on and off of the motor of the power tool, both of the control actions for the power tool can be accomplished by the operator by him or her only using one and the same hand. In particular, if the reversing means is placed adjacent to the thumb of the hand holding the grip of the power tool, this means and the on/off means can be efficiently actuated with the thumb and the first finger, which are eminently suitable and appropriate for such actuation. Thus, it is seen that according to the present invention there is provided an electric tool power switch assembly, which allows both the reversing mechanism and also the speed control mechanism to be incorporated together, so as to be fitted into the grip of the power tool, and which is efficient in its use of space and is convenient to use. Further, it is seen that this electric tool power switch assembly allows both the reversing mechanism and also the speed control mechanism to be operated with one and the same hand, and accordingly has good handleability and good usability, and has a high quality with regard to ergonomics, while yet being inexpensive.

According to an alternative particular specialization of the concept of the present invention, further, the above and other objects may be more particularly provided by an electric tool power switch assembly as specified above, wherein said means for controlling the on/off operation of said motor comprises a lever extending from the outside of said power switch assembly to the inside thereof, said lever being pivoted about a pivot line so as to actuate the on/off operation of said motor, and said lever being formed with an arcuate part cylindrical surface on its outside portion with respect to said pivot line, and said arcuate part cylindrical surface having substantially the same rotational center line as said pivot line. And, optionally but desirably, this electric tool power switch assembly should further comprise a sealing elastic member provided as sealingly cooperating with said arcuate part cylindrical surface of said lever.

In this case, as will be detailed later in the present specification, problems of ingress of dust or dirt or other contaminants into the interior of the casing of the electric tool power switch assembly are positively avoided, because a good sealing action is made available for the electric tool power switch assembly.

BRIEF DESCRIPTION OF THE DRAWINGS

The present invention will now be described with respect to the preferred embodiments thereof, and with reference to the illustrative drawings appended hereto, which however are provided for the purposes of explanation and exemplification only, and are not intended to be limitative of the scope of the present invention in any way, since this scope is to be delimited solely by the accompanying claims. With relation to the figures, spatial terms are to be understood as referring only to the orientation on the drawing paper of the illustrations of the relevant elements, unless otherwise specified; like reference symbols, unless otherwise so specified, denote the same parts and gaps and spaces and so on in the various figures relating to one preferred embodiment, and like parts and gaps and spaces and so on in figures relating to different preferred embodiments; and:

DESCRIPTION OF THE PREFERRED EMBODIMENTS

The present invention will now be described with reference to the preferred embodiments thereof, and with reference to the figures.

The First Preferred Embodiment

Figure 1:
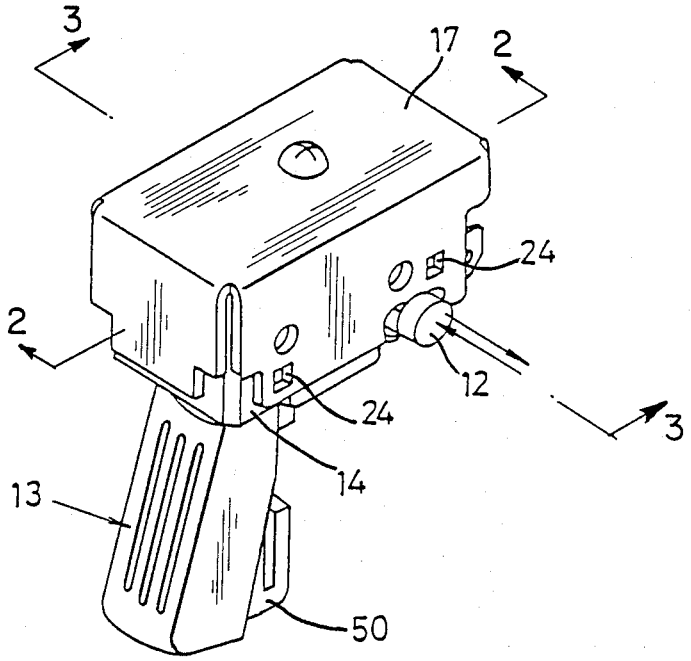
FIG. 1 is a general perspective view of the first preferred embodiment of the electric tool power switch assembly of the present invention.

FIGS. 1 through 7 relate to the first preferred embodiment of the electric tool power switch assembly of the present invention. Referring first to FIGS. 1 through 4, in these figures the reference numeral 11 denotes a control circuit unit for altering the intensity of the DC power which is supplied to a reversible DC type electric motor (not specifically shown) of the power tool (not shown in its entirety either), while the reference numeral 12 denotes a reversing unit for reversing the direction (or the polarity) of said DC electric power supplied to said electric motor, and the reference numeral 13 denotes a trigger lever for controlling the operation of said electric motor, and the reference numeral 14 denotes a casing for supporting all these components. Further, the figures show various other portions of the power tool, required for an understanding of the present invention. FIG. 1 shows a general perspective view of the preferred embodiment of the electric tool power switch assembly of the present invention as a whole. This preferred embodiment of the electric tool power switch assembly of the present invention is typically for being incorporated into the grip portion of an electric power tool such as a motor driven power screw driver.

Figure 2:
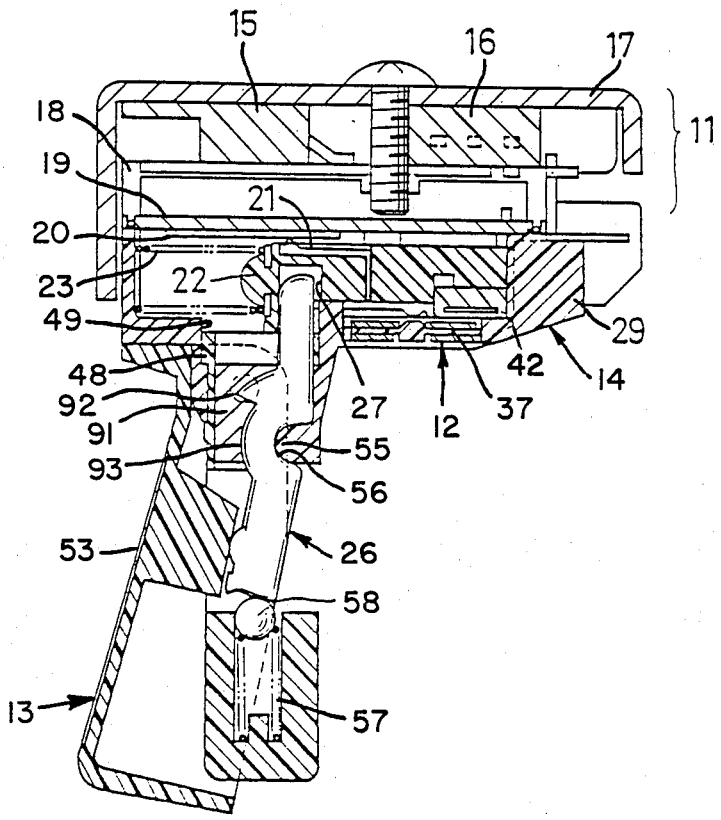
FIG. 2 is a sectional view of said first preferred embodiment electric tool power switch assembly, taken in a vertical and longitudinally extending plane with respect to the FIG. 1 view and shown by the arrows II—II in that figure.
Figure 3:
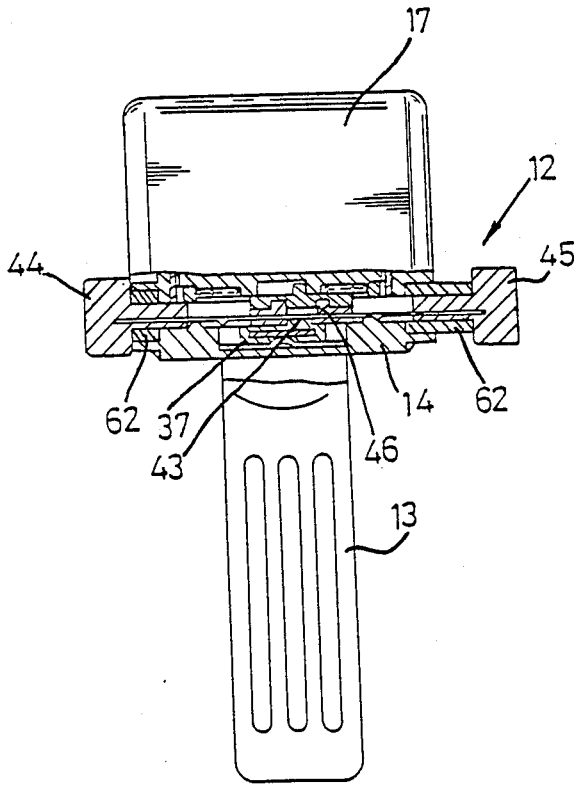
FIG. 3 is a partial sectional view of an essential portion of said first preferred embodiment electric tool power switch assembly, taken in a vertical and transversely extending plane with respect to the FIG. 1 view and shown by the arrows III—III in that figure.

Referring next to FIG. 2, which shows a sectional view of said first preferred embodiment electric tool power switch assembly taken in a vertical and longitudinally extending plane and shown by the arrows II—II in FIG. 1, the control circuit unit 11 comprises first and second field effect transistors 15 and 16 (so called "FET's"), a heat removal cover 17 which covers over these field effect transistors 15 and 16, a trellis shaped base board 18, a printed circuit board 19 which carries a control circuit, a resistive base board 20, a sliding brush 21 which provides a variable resistance by being slid over said resistive base board 20 so as to contact one or another longitudinally positioned portion thereof, an insulating slider member 22 which bears a movable contact and which carries said sliding brush 21 to thus longitudinally slide over said resistive base board 20, and a return spring 23 for biasing this insulating slider member 22 in the rightwards direction in FIG. 2.

The heat removal cover 17 is shaped generally in the form of a rectangular box with an open bottom, and the open bottom portion thereof surrounds the field effect transistors 15 and 16 and the trellis shaped base board 18, while rectangular engagement apertures 24 (vide the perspective view of FIG. 1) formed on either side of said heat removal cover 17 are engaged with corresponding rectangular engagement projections 25 which project from either side of the previously mentioned casing 14 for the power switch assembly of the present invention as a whole (vide the exploded view of FIG. 4), whereby the heat removal cover 17 is fitted over said casing 14.

At a front position on the lower surface of the insulating slider member 22 there is formed an actuating lever engagement depression 27, into which there is fitted the upper end as seen in the figures of an actuating lever 26 in such a manner that, as said actuating lever 26 is rockingly rotated to and fro about an arcuate pivot projection 55 which will be described later by the pushing action of the trigger lever 13, and as said upper end of said actuating lever 26 is moved in the horizontal direction as seen in FIG. 2, said insulating slider member 22 is driven in the horizontal direction as seen in said figure, i.e. is driven along its longitudinal direction. As a result of this action, the point of sliding contact between the sliding brush 21, which is mounted on a front portion of the upper surface in said figure of said insulating slider member 22, and the resistive base board 20, is altered, and thereby a resistive value, according to which torque control of the motor (not particularly shown) of the power tool is performed.

Now, the casing 14 is shaped generally in the form of a rectangular box with an open top, and the open top portion thereof receives the insulating slider member 22 in such a manner as to allow said insulating slider member 22 to slide back and forth along its longitudinal direction. The printed circuit board 19 and the field effect transistors 15 and 16 are placed over the insulating slider member 22, and the heat removal cover 17 and the trellis shaped base board 18 are integrally joined to the casing 14, with the rectangular engagement apertures 24 of the heat removal cover 17 and the trellis shaped base board 18 being engaged with the rectangular engagement projections 25 which project from either side of said casing 14.

Figure 4:
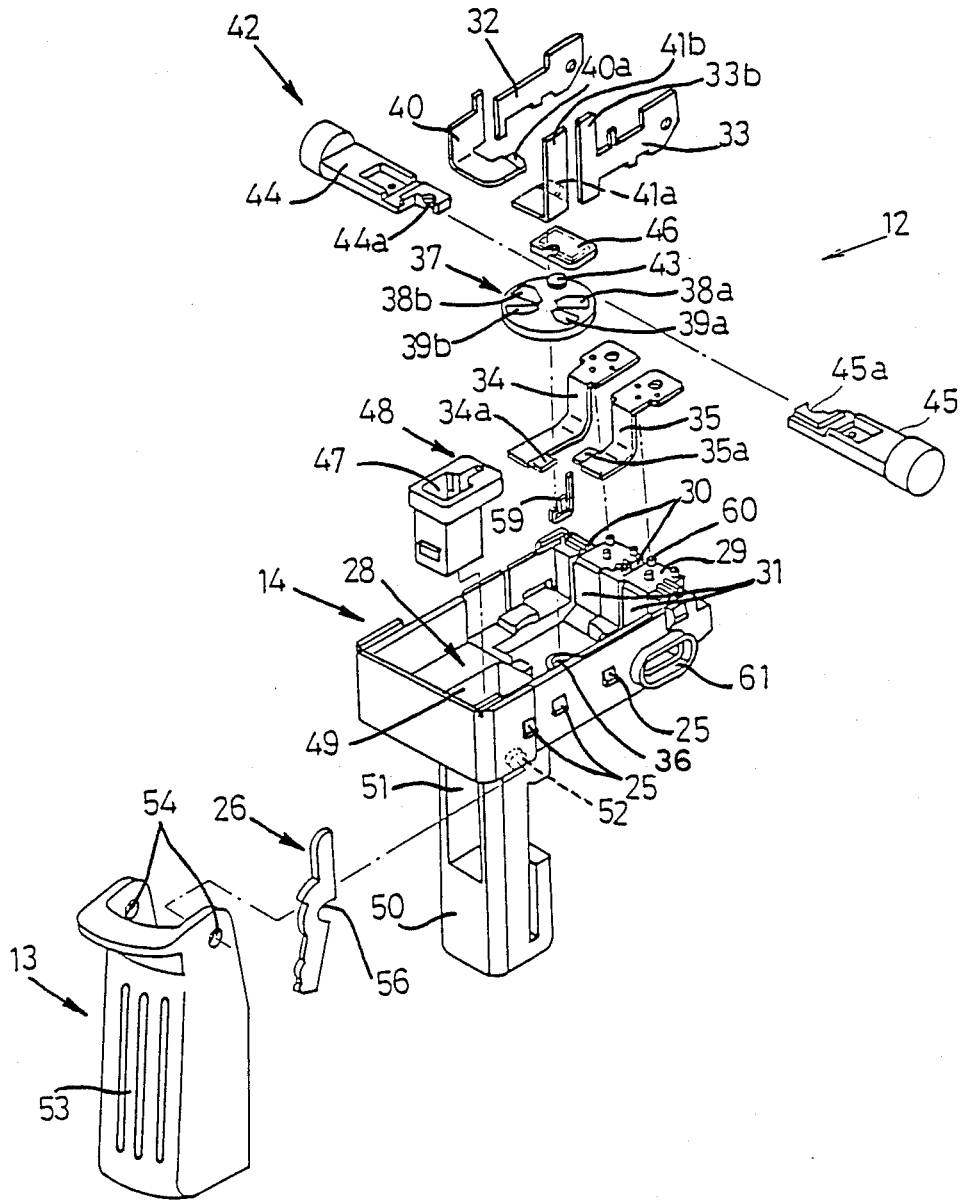
FIG. 4 is an exploded view of an essential lower portion of said first preferred embodiment electric tool power switch assembly.

Referring now to the exploded view of FIG. 4, the rear wall portion 29 of the upper open side of the casing 14 is formed with two slot shaped terminal mounting grooves 30 and with two terminal mounting depressions 31 positioned between said two slot shaped terminal mounting grooves 30. A positive power source terminal piece 32 and a negative power source terminal piece 33 are fitted, edge on, into these outer slot shaped terminal mounting grooves 30, while a first motor terminal piece 34 and a second motor terminal piece 35 are fitted, straight on, into the terminal mounting depressions 31.

In the approximate center of the upper surface in the figures of the bottom portion 28 of the casing 14 there is provided, extending upwards into the interior space of said casing 14, a tubular projection 36, on which there is rotatably supported an insulating actuating disk 37 which will now be described.

Figure 5:
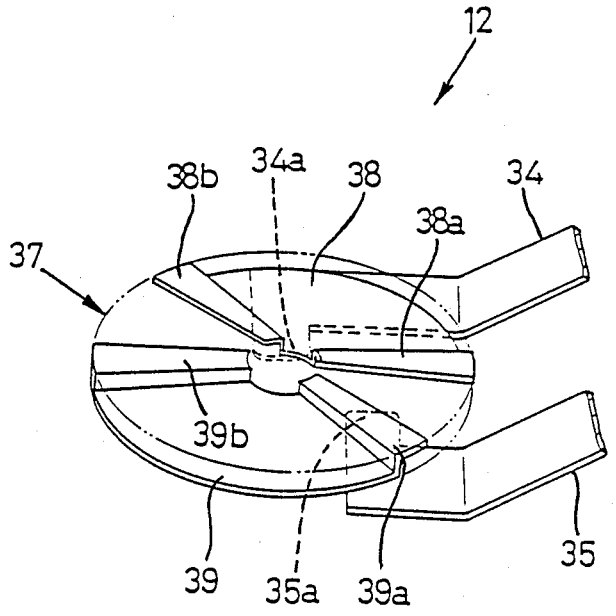
FIG. 5 is a perspective view of a reversing unit incorporated in said first preferred embodiment electric tool power switch assembly.

This insulating actuating disk assembly 37, as best seen in the perspective view thereof shown in FIG. 5, comprises a body portion not denoted by any reference numeral, and further comprises a first half moon plate 38 and a second half moon plate 39. These two half moon plates 38 and 39 are insert molded over the lower surface in the figures of the aforesaid body portion of the insulating actuating disk assembly 37, so as to constitute a single unitary member with a flush lower surface; and the insulating actuating disk assembly 37 as a whole can rotate about the common center of these two half moon plates 38 and 39. And the edge portions in both circumferential directions of the first half moon plate 38 are bent upward from the point of view of the figures and pass through the material of the body portion of the insulating actuating disk assembly 37, so as to appear on the upper side in the figures of said insulating actuating disk assembly 37 as contact sector portions 38*a* and 38*b*, while similarly the edge portions in both circumferential directions of the second half moon plate 39 are bent upward from the point of view of the figures and pass through the material of the body portion of the insulating actuating disk assembly 37, so as to appear on the upper side in the figures of said insulating actuating disk assembly 37 as contact sector portions 39*a* and 39*b*, the contact sector portion 38*a* of the first half moon plate 38 and the contact sector portion 39*a* of the second half moon plate 39 confront one another on the upper surface in the figures of the insulating actuating disk assembly 37, and similarly the other contact sector portion 38*b* of the first half moon plate 38 and the other contact sector portion 39*b* of the second half moon plate 39 confront one another on said upper surface in the figures of said insulating actuating disk assembly 37. As can be seen in FIG. 4, the material of the body portion of the insulating actuating disk assembly 37 extends somewhat in the radial direction outwards of the outer extreme extent of the first and second half moon plates 38 and 39, so as to ensure that said insulating actuating disk assembly 37 can stay integrally in one piece.

According to the arrangement of the terminals as shown in FIG. 4, an arcuate contact portion 34*a* formed on the end of the first motor terminal piece 34 presses against the lower surface from the point of view of the figures of the insulating actuating disk assembly 37 in such a manner as to be always in contact with the portion of the first half moon plate 38 which appears on said lower surface, thus ensuring electrical connection of said first motor terminal piece 34 and said first half moon plate 38 at all times as the insulating actuating disk assembly 37 rotates; and, similarly, an arcuate contact portion 35*a* formed on the end of the second motor terminal piece 35 presses against the lower surface from the point of view of the figures of the insulating actuating disk assembly 37 in such a manner as to be always in contact with the portion of the second half moon plate 39 which appears on said lower surface, thus ensuring electrical connection of said second motor terminal piece 35 and said second half moon plate 39 at all times as the insulating actuating disk assembly 37 rotates.

Figure 6:
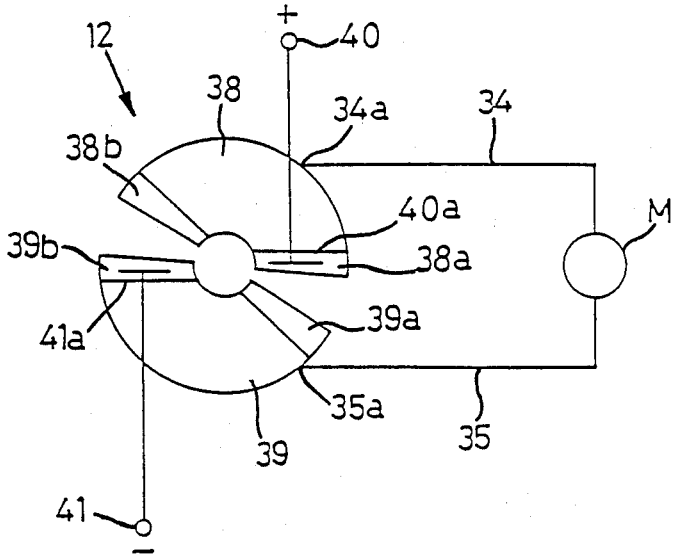
FIG. 6 is a schematic diagram showing the electrical connections to a motor of the electric tool provided by said FIG. 5 reversing unit of said first preferred embodiment electric tool power switch assembly, when it is positioned to a first so called normal operation position.
Figure 7:
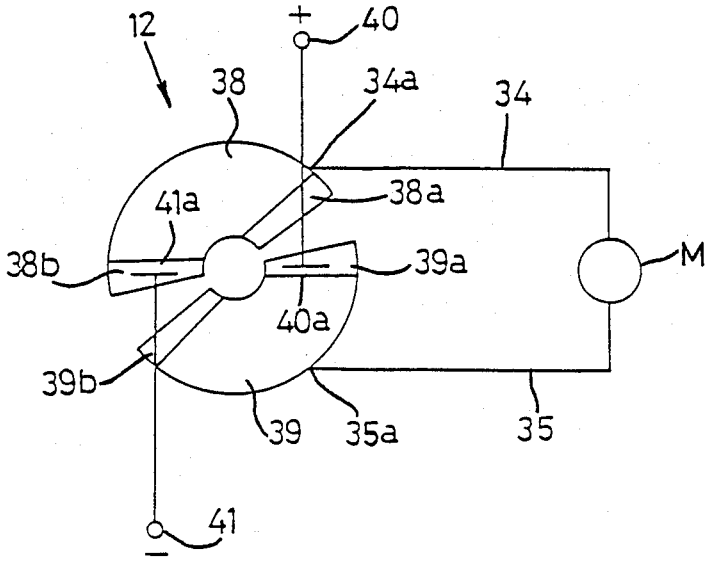
FIG. 7 is similar to FIG. 6, being a schematic diagram showing the electrical connections to said motor of said electric tool provided by said FIG. 5 reversing unit of said first preferred embodiment electric tool power switch assembly, when it is positioned to a second so called reverse operation position.

Further, when the insulating actuating disk assembly 37 is positioned to the most extreme position of its rotational travel in the clockwise direction, as shown in the schematic view of FIG. 6, then an arcuate contact portion 40*a* formed on the end of a positive power source element 40 comes to be brought into pressing contact with the contact sector portion 38*a* of the first half moon plate 38 on the one side, while an arcuate contact portion 41*a* formed on the end of a negative power source element 41 comes to be brought into pressing contact with the contact sector portion 39*b* of the second half moon plate 39 on the other side. Thereby, via electrical conduction through the first and second half moon plates 38 and 39, a positive DC electrical potential is supplied to the upper terminal as seen in the views of FIGS. 6 and 7 of the motor M of the electric tool, while a corresponding negative DC electrical potential is supplied to the lower terminal as seen in said views of said motor M. In this state of operation, the motor M turns in the so called normal rotational direction, and the power tool operates normally; for instance, in the case of a power screw driver, said power screw driver operates for screwing up a screw or a bolt.

On the other hand, when the insulating actuating disk assembly 37 is rotated through a certain angle in the counter clockwise direction from its position as shown in FIG. 6, by being impelled by a reverse actuator assembly 42 as will be described shortly, and becomes positioned to the most extreme position of its rotational travel in the counter clockwise direction as shown in the schematic view of FIG. 7, then said arcuate contact portion 40*a* formed on the end of the positive power source element 40 comes to be brought into pressing contact with the contact sector portion 39*a* of the second half moon plate 39 on the one side, while the arcuate contact portion 41*a* formed on the end of the negative power source element 41 comes to be brought into pressing contact with the contact sector portion 38*b* of the first half moon plate 38 on the other side. Thereby, via electrical conduction through the first and second half moon plates 38 and 39, a negative DC electrical potential is supplied to the upper terminal as seen in the views of FIGS. 6 and 7 of the motor M of the electric tool, while a corresponding positive DC electrical potential is supplied to the lower terminal as seen in said views of said motor M. In this state of operation, the motor M turns in the so called reverse rotational direction, and the power tool operates in the reverse manner; for instance, in the case of a power screw driver, said power screw driver operates for unscrewing a screw or a bolt.

In other words, the portion of the first half moon plate 38 which constitutes part of the lower surface of the insulating actuating disk assembly 37 is always in contact with the arcuate contact portion 34*a* formed on the end of the first motor terminal piece 34, while one or the other of the upper contact sector portions 38*a* and 38*b* thereof, which constitute parts of the upper surface of said insulating actuating disk assembly 37, is contacted to either the positive power source element 40 or to the negative power source element 41 respectively as the insulating actuating disk assembly 37 is rotated to its most extreme position in the clockwise direction as shown in FIG. 6 or to its most extreme position in the counter clockwise direction as shown in FIG. 7. Similarly, the portion of the second half moon plate 39 which constitutes another part of the lower surface of said insulating actuating disk assembly 37 is always in contact with the arcuate contact portion 35*a* formed on the end of the second motor terminal piece 35, while one or the other of the upper contact sector portions 39*a* and 39*b* thereof, which constitute other parts of said upper surface of said insulating actuating disk assembly 37, is contacted to either the negative power source element 41 or to the positive power source element 40 respectively as the insulating actuating disk assembly 37 is rotated to its most extreme position in the clockwise direction as shown in FIG. 6 or to its most extreme position in the counter clockwise direction as shown in FIG. 7.

Now, the positive power source element 40 and the negative power source element 41 are fixed along the inner wall of the upper opening 28 of the casing 14. Further, a portion of the positive power source element 40 is connected to an electroconductive portion of the trellis shaped base board 18, while a portion of the positive power source terminal piece 32 is likewise connected to the same said electroconductive portion of said trellis shaped base board 18; and an upright portion 41*b* of the negative power source element 41 is connected to another electroconductive portion of said trellis shaped base board 18, while an upright portion 33*b* of the negative power source terminal piece 33 is likewise connected to the same said electroconductive portion of said trellis shaped base board 18.

There is formed, projecting upwards as seen in the figures from a peripheral portion of the upper surface in the figures of the insulating actuating disk assembly 37, a projecting engagement pin 43, suitable for engaging with the reverse actuator assembly 42. This reverse actuator assembly 42 will now be described: it comprises a first push assembly 44 which extends in the transverse direction and which is supported by the casing 14 in a slidable manner and an outer end of which projects from said casing 14 on a one side, and a second push assembly 45 which also extends in the same transverse line and which is similarly supported by the casing 14 in a slidable manner and an outer end of which projects from said casing 14 on the other side. The inner end of the first push assembly 44 is formed with a hook shape **44*a* which engages with the circumferential surface of the projecting engagement pin 43 of the insulating actuating disk assembly 37 on its one side, and correspondingly the inner end of the second push assembly 45 is formed with a hook shape 45*a* which engages with said circumferential surface of said projecting engagement pin 43 of said insulating actuating disk assembly 37 on its other side. And, in this state, a push assembly connecting piece 46 is fitted over the hook shape 44*a* of the first push assembly 44 and over the similar hook shape 45*a* of the second push assembly 45 so as to link together said first and second push assemblies 44 and 45. Thus, in the assembled state, the outer ends of the reverse actuator assembly 42 project on either side of the casing 14 of this preferred embodiment of the electric tool power switch assembly of the present invention, the distance between said outer ends of said reverse actuator assembly 42 being greater than the width in the transverse direction of said casing 14, by an amount just suitable for turning the insulating actuating disk assembly 37 between its two opposite extreme rotational positions as shown in FIGS. 6 and 7 for connecting the motor M of the electric tool to be driven in respectively the forward or the reverse rotational direction, when first one end of the reverse actuator assembly 42 is pressed towards the casing 14 by a finger or thumb of an operator while the other end of said reverse actuator assembly 42 is left unpressed, and then subsequently said one end of said reverse actuator assembly 42 is left unpressed while said one end of said reverse actuator assembly 42 pressed towards said casing 14** by a finger or thumb of said operator.

In a front portion of the bottom surface in the figures of the casing 14 there is formed a cap mounting hole 49 for mounting a guide cap 48 which is formed with an actuating lever passing hole 47. The upper end in the figures of the actuating lever 26 is inserted into the interior of the casing 14, so as to be engaged with the actuating lever engagement depression 27 of the insulating slider member 22, via this actuating lever passing hole 47.

A support member 50 is fixed to and descends from the lower surface in the figures of the casing 14, and is formed with a slot 51 which extends in the fore and aft direction of the switch assembly, said slot 51 communicating with the actuating lever passing hole 47. And a pair of pivot pins 52 are formed as extending outwards at corresponding positions on the outer side surfaces of this support member 50 at upper positions thereupon, for pivotally supporting the trigger lever 13, previously mentioned. This trigger lever 13 is shaped in a gutter shape or in the shape of a half tube longitudinally split by a plane including its central axis, and an actuating pressure surface 53 is defined on the front facing surface of said trigger lever 13, while two pivot holes 54 are formed at opposing sides of the upper end portion of said trigger lever 13. Each of these two pivot holes 54 is fitted over one of the pivot pins 52 formed on the casing 14, and thereby the trigger lever 13 is pivotally mounted to the casing 14, so as to be able to rock back and forth around the axis of the pivot pins 52.

The actuating lever 26 is used for conveying mechanical movement from this trigger lever 13 to the insulating slider member 22, mentioned earlier. In detail (this can best be seen in FIG. 2) the actuating lever 26 is fitted within the slot 51 of the support member 50, and is shaped with a semicircular depression 56 at its longitudinally central portion. This semicircular depression 56 fits over and against an arcuate pivot projection 55 formed at an appropriate position on the support member 50, and thereby the actuating lever 26 is mounted so as to pivotingly rock to and fro on the arcuate pivot projection 55. As mentioned before, the upper end of the thus pivoted actuating lever 26 is passed through the actuating lever passing hole 47 into the interior of the casing 14 and is then engaged with the actuating lever engagement depression 27 of the insulating slider member 22, so that rocking rotation of the actuating lever 26 slides said insulating slider member 22 to and fro, and the lower end of the actuating lever 26 is supported and is biased in the upward direction in FIG. 2 by a ball 58, which is mounted in a hole formed in the lower portion in the figure of the support member 50 and is biased upwards therein by a compression coil spring 57. And a rearwardly projecting portion of the trigger lever 13 bears against the actuating lever 26, so as to rock said actuating lever 26 to and fro about the arcuate pivot projection 55, as the trigger lever 13 is pivoted to and fro about the pivot pins 52.

In FIG. 4, the reference numeral 59 denotes a gate terminal, while the reference numeral 60 denotes a terminal fixing pin and the reference numeral 61 denotes a rimmed aperture for passing the second push assembly 45 (a similar rimmed push assembly aperture 61 for passing the first push assembly 44 is formed on the other side of the casing 14 but is not visible in this figure). Further, in FIG. 3, the reference numeral 62 is utilized in order to denote both of two compressible sponge seal members which are provided around the portions of the first push assembly 44 and the second push assembly 45 which pass through these rimmed push assembly apertures 61; these two sponge seal members 62 are used for sealing the casing 14 against the ingress of dust, dirt, or the like contaminants, which otherwise might penetrate from the outside to the interior of the casing 14 through the apertures 61 past the push assemblies 44 and 45.

Referring now back to FIG. 2, the reference numeral 91 denotes a sponge seal member which is provided around the portion of the actuating lever 26 which passes through the guide cap 48, between said actuating lever 26 and said guide cap 48. This again is for sealing the casing 14 against the ingress of dust, dirt, or the like contaminants, which otherwise might penetrate from the outside to the interior of the casing 14 through the aperture of the guide cap 48 past the actuating lever 26. In more detail, the arcuate left surface as seen in this figure of the actuating lever 26, on the other side thereof from the semicircular depression 56 formed therein which is pivotingly fitted on the arcuate pivot projection 55, and denoted as 93 in the figure, is formed as a part cylindrical surface which has substantially the same center line as is the pivot line of the actuating lever 26 on said arcuate pivot projection 55. By this formation, as the actuating lever 26 is pivotingly rotated about said arcuate pivot projection 55 during the use of this switch assembly, the arcuate surface 93 moves smoothly without slithering radially inwards and outwards, and particularly does not either compress or release the portion of the sponge seal member 91 against which said arcuate surface 93 is pressed, but simply slides smoothly against and past said portion of said sponge seal member 91. Accordingly, a sealing performance is available from the sponge seal member 91 which is substantially as good as the sealing performance of a static type seal, even though in actuality what is used is a dynamic seal arrangement. Thus, by forming the arcuate surface 93 so as to minimize the alteration of the radial position of said arcuate surface 93 as the actuating lever 26 is rotated, it is possible to provide a sealing structure which is effective for keeping out dust, dirt, and other contaminants at a very low cost.

A projection 92 is provided on this arcuate surface 93 of the actuating lever 26 at a position above the arcuate pivot projection 55 in the figure, so as to define the position of the sponge seal member 91 held in the guide cap 48 in a stable manner, in order to achieve a high sealing performance.

Application and Operation of this First Preferred Embodiment

This first preferred embodiment of the electric tool power switch assembly of the present invention is applied as follows. The casing 14 thereof is mounted within the upper portion of the grip portion of a power tool such as a power screw driver or the like, in a position which is suitable for the trigger lever 13 thereof, when not squeezed, to project—under the biasing action of the return spring 23 fitted for biasing the insulating slider member 22 which however also serves for biasing the trigger lever 13—obliquely and forwardly from the front surface of said power tool grip portion, so that a user can actuate said trigger lever 13 by depressing it.

By the user thus depressing the trigger lever 13, i.e. rotating said trigger lever 13 in the counter clockwise direction in FIG. 2, the actuating lever 26 is likewise rotated in the counter clockwise direction in that figure, and this causes the upper end of said actuating lever 26 to drive the insulating slider member 22 forwards, i.e. leftwards in FIG. 2, and this sliding action causes the power to be turned on and causes the motor M thereby to be activated. By the suitable adjustment by the hand of the user of the stroke of the trigger lever 13, the point of contact between the sliding brush 21 mounted on the insulating slider member 22 and the resistive base board 20 is altered, and this causes the speed control circuit including the field effect transistors 15 and 16 (which is not particularly detailed in this specification because it may be of a type which is per se known and conventional, and various possibilities for such a control circuit will be apparent to one of ordinary skill in the relevant art without undue experimentation) to vary the torque of the motor M to any desired value as suitable for the particular current operational circumstances of the power tool.

On the other hand, when the user of the power tool releases the trigger lever 13 from its thus depressed state, then the biasing action of the return spring 23 pushes the insulating slider member 22 in the rearwards direction, i.e. to the right in FIG. 2, and this rotates the actuating lever 26 and the trigger lever 13 with it both in the clockwise direction in this figure, so as to return said trigger lever 13 to its original position, and simultaneously the insulating slider member 22 reaches its original position in which the sliding brush 21 mounted thereon reaches a position which, via the aforementioned control circuit including the field effect transistors 15 and 16, turns the motor M off.

The above description has assumed that the insulating actuating disk assembly 37 is in its position as shown in FIG. 6, i.e. is in its position as rotationally displaced to the maximum in the clockwise direction. In this position, the motor M will be connected to the power source, via the first half moon plate 38 and the second half moon plate 39, in the direction to ensure that said motor M turns in the so called normal or forward direction, as explained above. Specifically, in the first preferred embodiment of the electric tool power switch assembly of the present invention shown in the figures and described above, this will be when the reverse actuator assembly 42 is in its position with the first push assembly 44 thereof pushed inwards towards the casing 14 to the maximum extent, typically so as to be flush with said casing 14 or almost so, while on the other hand the other or second push assembly 45 thereof projects out from said casing 14 (to the right side from the point of view of FIG. 4) to the maximum extent.

On the other hand, if it is desired by the operator of the power tool to reverse the operational direction of the motor M, while still of course maintaining the controllability of the torque of said motor M by the pulling of the trigger lever 13 as described above, then said operator merely needs to push on the external or terminal end of the second push assembly 45 of the reverse actuator assembly 42, while not interfering with the external end of the first push assembly 44. This will cause the reverse actuator assembly 42 to move in the leftward direction from the point of view of FIG. 4, in the transverse direction of the grip portion of the power tool, i.e. in the direction in which the operator is exerting gripping action on said power tool, and at an angle to the direction in which the operator is typically pulling the trigger lever 13 for torque control of said motor M. And, as a result, the insulating actuating disk assembly 37 is rotated in the counter clockwise direction from its position as shown in FIG. 6 so as to reach its other extreme position as shown in FIG. 7, and so that now the motor M will be connected to the power source, via the first half moon plate 38 and the second half moon plate 39, in the direction to ensure that said motor M turns in the so called reverse direction, as explained above. Specifically, in the first preferred embodiment of the electric tool power switch assembly of the present invention shown in the figures and described above, this will be when the reverse actuator assembly 42 is in its position with the second push assembly 45 thereof pushed inwards towards the casing 14 to the maximum extent, typically so as to be flush with said casing 14 or almost so, while on the other hand the other or first push assembly 44 thereof projects out from said casing 14 (to the left side from the point of view of FIG. 4) to the maximum extent.

Thus it is seen that, in this first preferred embodiment of the electric tool power switch assembly of the present invention, the rotational direction of the motor M of the power tool can be reversed simply by transversely pushing the one end or the other of the reverse actuator assembly 42 in and out relative to the casing 14, and this can be conveniently done by the operator by using the same hand as that which is holding the grip portion of the power tool. Further, since this reversing action is in the same direction as the action of gripping the power tool, and is set at an angle (specifically, a right angle, i.e. skew perpendicular) to the action of controlling the torque provided by the power tool which action is applied in the back and forth direction, both of the control actions for the power tool can be accomplished by the operator by him or her only using one and the same hand.

Thus, it is seen that according to the present invention there is provided an electric tool power switch assembly, which allows both the reversing mechanism and also the speed control mechanism to be incorporated together, so as to be fitted into the grip of the power tool, and which is efficient in its use of space and is convenient to use. Further, it is seen that this electric tool power switch assembly allows both the reversing mechanism and also the speed control mechanism to be operated with one and the same hand, and accordingly has good handleability and good usability, and has a high quality with regard to ergonomics, while yet being inexpensive.

The Second Preferred Embodiment

Figure 8:
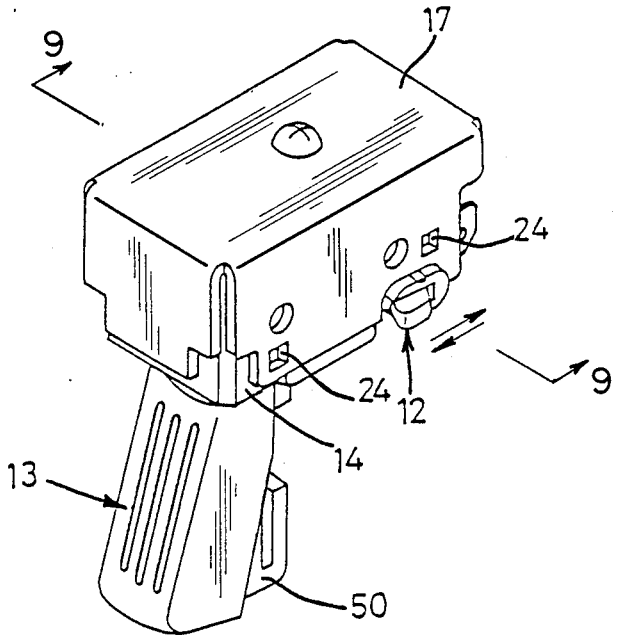
FIG. 8 is similar to FIG. 1 relating to the first preferred embodiment, being a general perspective view of the second preferred embodiment of the electric tool power switch assembly of the present invention.
Figure 9:
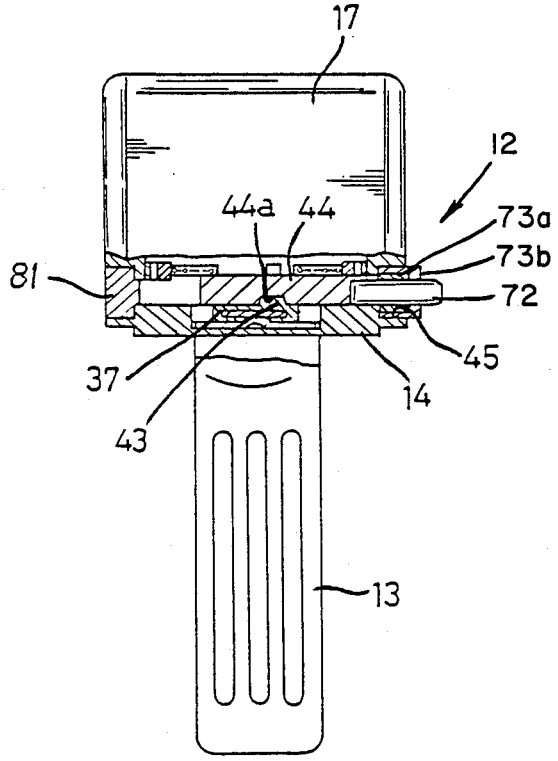
FIG. 9 is similar to FIG. 3 relating to the first preferred embodiment, being a partial sectional view of an essential portion of said second preferred embodiment electric tool power switch assembly, taken in a vertical and transversely extending plane with respect to the FIG. 8 view and shown by the arrows IX—IX in that figure.
Figure 10:
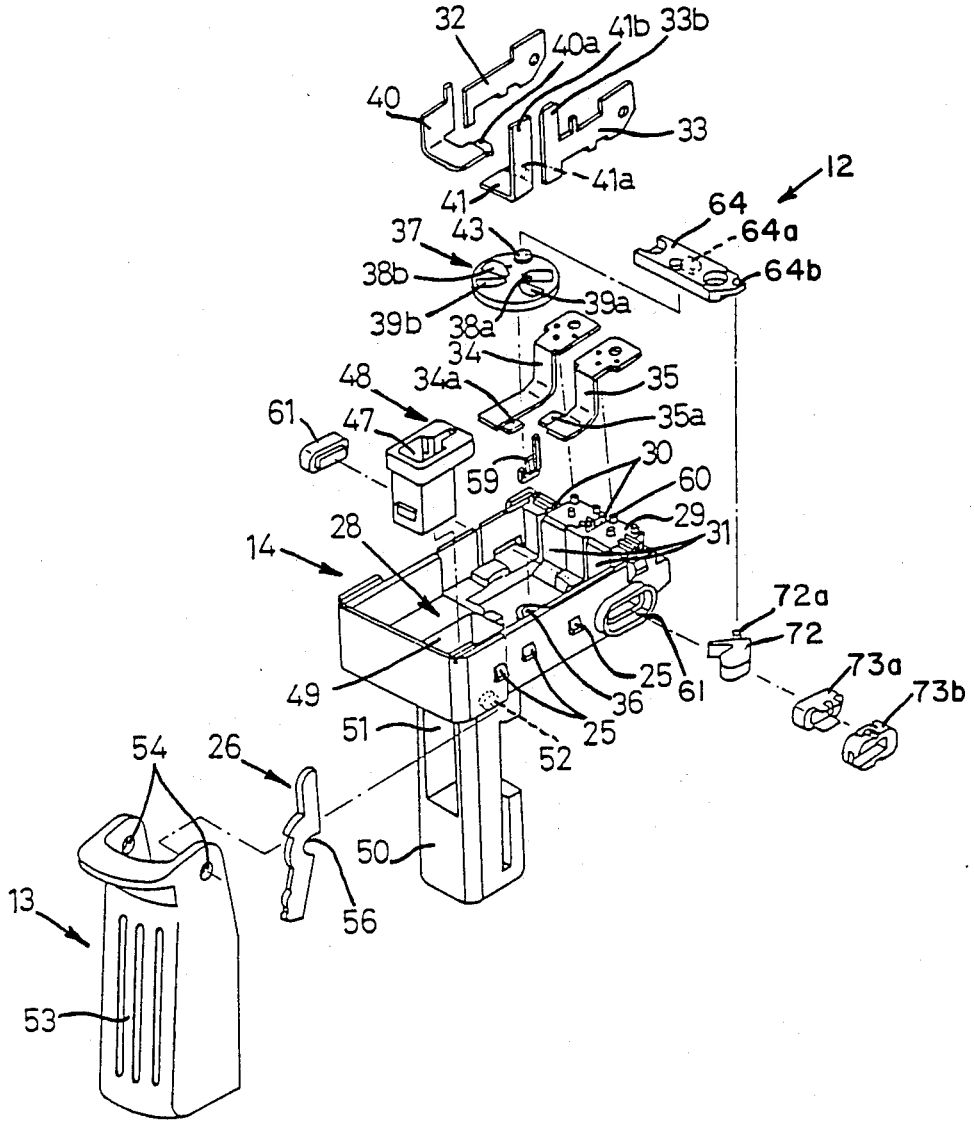
FIG. 10 is similar to FIG. 4 relating to the first preferred embodiment, being an exploded view of an essential lower portion of said second preferred embodiment electric tool power switch assembly.

Next, with regard to FIGS. 8 through 10, the second preferred embodiment of the electric tool power switch assembly of the present invention will be described. It should be understood that, in FIGS. 8 through 10, like reference symbols to reference symbols in previous figures relating to the first preferred embodiment correspond to like elements. FIG. 8 is similar to FIG. 1 relating to the first preferred embodiment, being a general perspective view of the second preferred embodiment of the electric tool power switch assembly of the present invention; FIG. 9 is similar to FIG. 3 relating to the first preferred embodiment, being a partial sectional view of an essential portion of said second preferred embodiment electric tool power switch assembly, taken in a vertical and transversely extending plane with respect to the FIG. 8 view and shown by the arrows IX—IX in that figure; and FIG. 10 is similar to FIG. 4 relating to the first preferred embodiment, being an exploded view of an essential lower portion of said second preferred embodiment electric tool power switch assembly.

This second preferred embodiment of the present invention only differs from the first preferred embodiment, described above, in the details of the construction and operation of the reversing unit 12, and accordingly only this will be described, while description of the other parts of the construction, which are substantially the same as in the case of said first preferred embodiment, is omitted in the interests of brevity of description.

In detail, as before, there is formed, projecting upwards as seen in the figures from a peripheral portion of the upper surface in the figures of the insulating actuating disk assembly 37, a projecting engagement pin 43, suitable for engaging with the reverse actuator assembly. This reverse actuator assembly, in this second preferred embodiment, comprises a slide rod 64, on the under surface of which from the point of view of the figure there is formed a rectangular aperture 64*a* which is engaged over said projecting engagement pin 43. The slide rod 64 is slidably fitted in the casing 14 from one side thereof, and to the external end of said slide rod 64 there is pivoted a switching lever 72, via a pivot pin 72*a* which is provided on the upper surface as seen in the figure of said switching lever 72 being pivotally engaged in a pivot depression 64*b* which is formed on the under surface as seen in the figure of said slide rod 64. The switching lever 72 is allowed to rock to and fro by a certain amount around this pivot point, and the limits of the rocking travel of said switching lever 72, i.e. of the angle of rotational displacement thereof, are determined by a first fixed stop member 73*a* and a second fixed stop member 73*b*, both of which are fixed to the edge of the rimmed push assembly aperture 61 of the casing 14, through which this switching lever 72 projects.

Thus, by this rocking motion being imparted to the switching lever 72, which may be done by the thumb of the operator of the power tool pushing the outer end of said switching lever 72 to and fro, the slide rod 64 is pushed to and fro in the transverse direction with regard to the casing 14, and rotates the insulating actuating disk assembly 37 via the projecting engagement pin 43, to produce the same effects with regard to operating the motor M of the power tool, both backwards and forwards, as in the case of the first preferred embodiment of the present invention described above. In other words, when the operator desires to operate the motor M of the power tool in the normal or forward direction, he or she pushes the outer end of the switching lever 72, typically with his or her thumb, in the forward direction with respect to the casing 14; while, when on the other hand said operator desires to operate said motor M of said power tool in the reverse direction, he or she pushes the outer end of the switching lever 72, again typically with his or her thumb, in the backwards direction with respect to said casing 14.

It will be clear that, since in this second preferred embodiment of the electric tool power switch assembly of the present invention the direction of actuation of the lever for selectively reversing the operation of the motor of the power tool to which said power switch assembly is applied is substantially parallel to and displaced from the direction of actuation of the lever (the trigger lever 13) for controlling the torque of said motor, thereby the arrangement of the levers is made very convenient, and, since these two levers can be arranged in suitable and advantageous positions in the grip portion of the power tool, said two levers can be easily actuated with the same single hand holding said power tool grip.

Conclusion

It is acceptable, according to the principle of the present invention, if the constructional details of the system are varied, although the shown ones are considered to be preferred. For example, the could, in other embodiments, be a , rather than being a like the utilized for the shown preferred embodiments. Also, even if said were as exemplarily shown above to be a , it could be provided, not as was the case with the shown preferred embodiments of the present invention, but , and substantially the same effect would be provided as in the case which has been shown and described. Other modifications could also be conceived of. Therefore, although the present invention has been shown and described in terms of the preferred embodiments thereof, and with reference to the appended drawings, it should not be considered as being particularly limited thereby, since the details of any particular embodiment, or of the drawings, could be varied without, in many cases, departing from the ambit of the present invention. Accordingly, the scope of the present invention is to be considered as being delimited, not by any particular perhaps entirely fortuitous details of the disclosed preferred embodiments, or of the drawings, but solely by the scope of the accompanying claims, which follow.

What is claimed is:

1. A switch assembly for an electric motor in an electric power tool, said assembly comprising:

a casing;

a support member supporting said casing;

a resistive board member disposed in said casing;

a brush member for slideably contacting said resistive board member;

a slider member disposed movably to and fro for supporting said brush member;

an arcuate pivot portion formed on said support member; and an actuating member for actuating said slider member to and fro, wherein said actuating member is pivotably supported around said pivot portion, said actuating member including a first arcuate surface fitted around said pivot portion and a second arcuate surface opposite said first surface.

2. A switch assembly according to claim 1, further comprising a sealing elastic member provided as sealingly cooperating with said second arcuate surface.

* * * * *